US005471750A

United States Patent [19]

Deboi

[11] Patent Number: 5,471,750

[45] Date of Patent: Dec. 5, 1995

[54] DRYWALL CUTTING AND SCORING DEVICE

[75] Inventor: Richard S. Deboi, 7220 Central Ave., Apt. 1092, Bldg. I, Albuquerque, N.M. 87108

[73] Assignee: Richard S. Deboi, Albuquerque, N.M.

[21] Appl. No.: 237,767

[22] Filed: May 4, 1994

[51] Int. Cl.[6] ..... B26B 29/06

[52] U.S. Cl. ..... 30/290; 30/293

[58] Field of Search ..... 30/286, 289, 290, 30/293, 294; 7/163, 164; 33/41.1, 42

[56] References Cited

U.S. PATENT DOCUMENTS

| | | | |
|---|---|---|---|
| 2,090,183 | 8/1937 | Capstick | 30/293 |
| 2,529,210 | 11/1950 | Butler | 30/294 |
| 2,818,644 | 1/1958 | Crawford | 30/293 |
| 2,952,025 | 4/1959 | Johnson | 7/164 |
| 4,903,409 | 2/1990 | Kaplan et al. | 30/293 |
| 4,949,462 | 11/1988 | Spencer | 30/293 |
| 5,048,189 | 9/1991 | Aurness et al. | 30/293 |
| 5,050,306 | 9/1991 | Renaud | 30/293 |
| 5,083,375 | 6/1991 | Helm | 30/294 |
| 5,231,764 | 8/1993 | Chang | 30/293 |
| 5,265,342 | 10/1992 | Lang | 30/294 |

*Primary Examiner*—Kenneth E. Peterson

[57] ABSTRACT

An improved drywall cutting and scoring device which can quickly cut drywall transversely, longitudinally, and at right angles, without the need for separeate measuring, marking, chalk-lining, and cutting steps. The device includes an elongated measuring bar (14), having four planar measuring indicia extending longitudinally between its opposite ends. Telescopic guide rails (22, 24) extend from one end of the measuring bar, parallel along its length in a laterally spaced relationship. A drywall panel is cut by first depressing the locking button (48) and then moving the adjustable block (10) to any selected setting. The tool is positioned on the drywall panel (68) so that the adjustable block is mounted against one edge of the drywall panel. Rollers (46) rollably ride on the face of the drywall panel adjacent the panel edge against which the associated adjustable block is adapted to slide. The device is then drawn along the drywall panel while being depressed so as to cause a razor-sharp cutting blade (66) to penetrate and cut the drywall panel to the dimension selected.

6 Claims, 9 Drawing Sheets

DRYWALL CUTTING AND SCORING DEVICE

BACKGROUND OF THE INVENTION

1. Field of the Invention

This invention relates to drywall cutting and scoring devices which can quickly, easily, and accurately cut drywall transversely, longitudinally, and at right angles, without the need for separate measuring, marking, chalk-lining, and cutting steps.

2. Description of the Prior Art

Drywall is commonly used in place of plaster in the construction of interior walls and ceilings because it saves both time and money compared to traditional construction using wet plaster. Drywall consists of a thin layer of plaster-like material, commonly gypsum, sandwiched between two pieces of heavy paper and is available in standard widths or panels.

Because drywall panels are manufactured in standard sizes, such as four feet by eight feet or four feet by twelve feet, installers must measure and cut many pieces to fit in small spaces such as above and below windows, skylights, etc.

The drywall industry has long attempted to provide a practical tool which could minimize the marking and scoring steps associated with drywall cutting. A T-square and utility knife has proved to be useful, but is limited to cutting drywall that is exactly four feet and requires measuring and chalk-lining prior to cutting or scoring. Various attempts have been devised by inventors to overcome these shortcomings, as indicated by the prior art.

U.S. Pat. No. 5,265,342 to Lang (1992) discloses a drywall cutting device which uses friction to bind a guide to a measuring stem. While this method of locking the guide to the measuring stem might work initially, the handle is awkward for practical use and the guide would be prone to slipping with regular and repeated use. Moreover, the tool requires a special blade that would make manufacturing more expensive. Furthermore, since the guide portion is connected to the cutting element by only a single rod, the cutting element would tend to move from side-to-side while cutting, resulting in an inaccurate cut.

U.S. Pat. No. 5,083,375 to Helm (1991) shows a cutting device which is both awkward and impractical. For example, since it is understood that drywall is commonly manufactured in widths of 48 inches, cutting two inches off the wallboard would produce the same overall effect as cutting 46 inches off the wallboard. In both instances, the finished results would both be approximately the same: one piece cut at two inches and the other piece cut at 46 inches. Obviously, then, it should be evident, that the width of a drywall panel can be cut quicker, easier, and with greater precision, when working in the range of 0 to 24 inches; rather than working in the range 24 inches to 48 inches. Helm's device does not take this important fact into consideration and thus, cutting pieces greater than 24 inches would always be more difficult and less accurate. Furthermore, having to loosen and tighten a locking knob with each cut would make the tool impractical.

U.S. Pat. No. 4,949,462 to Spencer (1988) discloses a drywall cutting device which works much the same way as Helm's, and with many of the similar shortcomings; except the combined larger size of this device would make it particularly awkward for cutting very small pieces of wallboard. Small pieces of wallboard require more sensitivity and control when cutting and are more difficult to cut because the wallboard has a tendency to slip-out away from the knife.

U.S. Pat. No. 2,952,025 to Johnson (1959) combines a simple tape measure with a utility knife which is not too different from the way many installers presently cut drywall.

OBJECTS AND ADVANTAGES

Accordingly, besides the objects and advantages of the drywall cutting device described above, several other objects and advantages of the present invention are:

(a) to provide a drywall cutting and scoring device which can quickly, easily, and accurately cut pieces of drywall transversely, longitudinally, and at right angles, without the need for separate measuring, marking, chalk-lining, and cutting steps;

(b) to provide a drywall cutting and scoring device which can be quickly set to a given measurement by depressing a simple button;

(c) to provide a drywall cutting and scoring device which will accurately cut or score drywall in lengths of 0 to 4 feet, 6 feet to 8 feet, and 10 feet to 12 feet;

(d) to provide a drywall cutting and scoring device which utilizes a standard razor-sharp utility knife blade and which can be changed with a replacement blade simply by loosening a wing nut;

(e) to provide a drywall cutting and scoring device which utilizes rollers to move across the face of a wallboard with less friction;

(f) to provide a drywall cutting and scoring device which features a fine ruler adjustment, ensuring precision cutting;

(g) to provide a drywall cutting and scoring device which will pierce wallboard material more easily and will cut to a uniform depth;

(h) to provide a drywall cutting and scoring device which will cut small pieces of wallboard as easily as it will cut large pieces of wallboard;

(i) to provide a drywall cutting and scoring device which will cut straight;

(j) to provide a drywall cutting and scoring device which will accurately cut narrow strips of wallboard;

(k) to provide a drywall cutting and scoring device effective to cut any thickness of drywall;

(1) to provide a drywall cutting and scoring device which is easily grasped and operated by hand; and (m) to provide a drywall cutting and scoring device with improved elements and arrangements thereof in an apparatus for the purposes described which is dependable and fully effective in accomplishing its intended purposes.

Further objects and advantages are to provide a drywall cutting and scoring device which is practical and simple to use, which is compact and lightweight and which is inexpensive to manufacture. Still further objects and advantages of my invention will become apparent from a consideration of the drawings and ensuing description.

DESCRIPTION OF THE PREFERRED EMBODIMENT

For the purposes of this description, the term guide rail(s) shall mean guide rod 24 and guide tube extension 22; the term block portions shall mean adjustable block 10 and stationary block 12.

Figure 1:
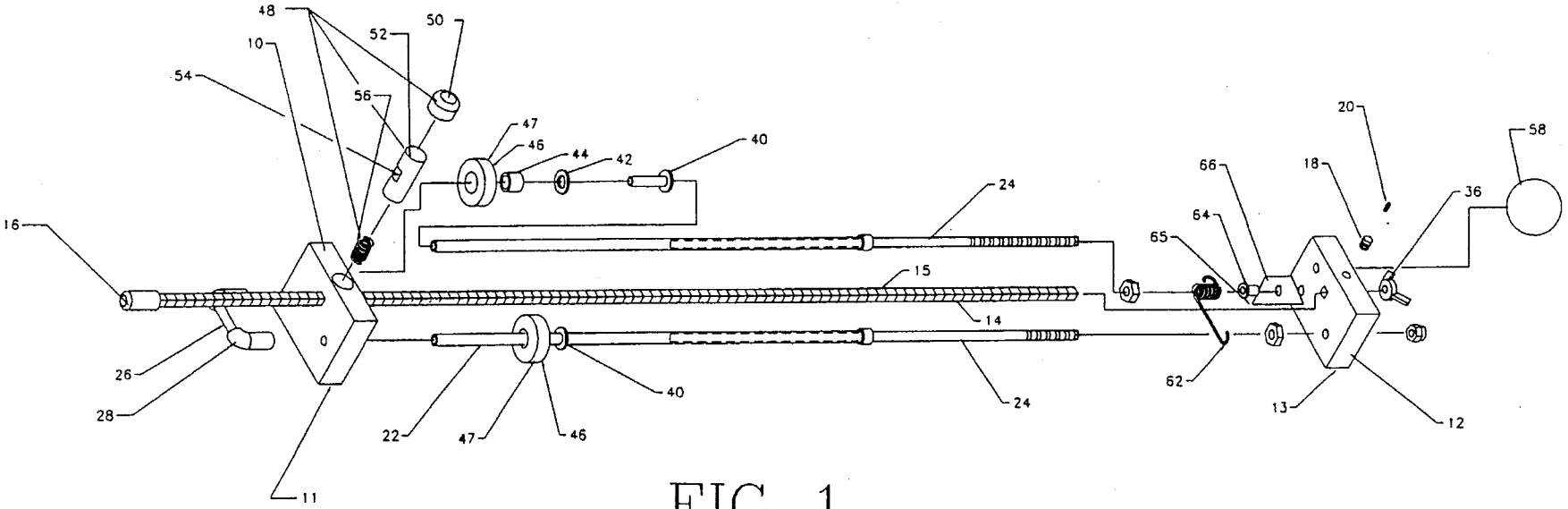
FIG. 1 shows an exploded perspective view of the drywall cutting and scoring device.

In this form of the present invention chosen for purposes of illustration in FIG. 1, the tool comprises an elongated measuring means, preferably a bar 14, square in cross-section and having four planar surfaces on which measuring indicia 15 are mounted or marked, extending longitudinally between its ends. Guide rails 22, 24 extend from adjacent one end of the measuring bar 14, parallel along its length, and in a laterally spaced relationship therewith. Generally rectangular-shaped relatively moveable block portions 10, 12 connect with said measuring bar at each end thereof; said block portions extend substantially perpendicular to said measuring bar 14 and guide rails 22, 24.

Figure 2:
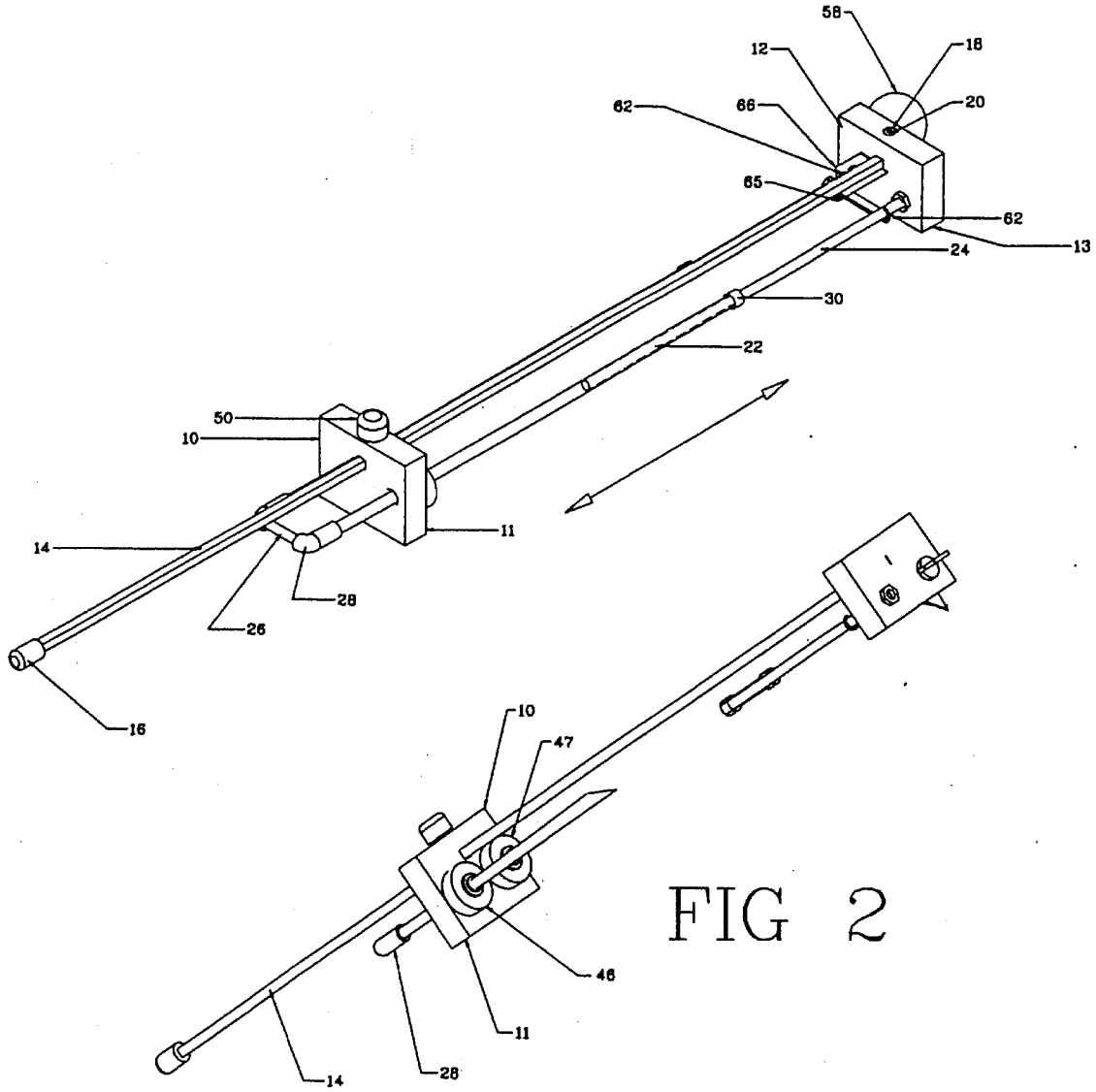
FIG. 2 is a perspective view of the present invention showing the guide tube extensions in operation.

FIG. 2 shows the guide tube extensions 22 in operative association with the guide rods 24. As illustrated by the arrow in the drawing, the guide rails 22, 24 are telescopic, having sections that slide one inside the other comprising laterally spaced parallel guide rods 24 and correspondingly laterally spaced and parallel guide tube extensions 22. The length of the guide rods 24 are approximately the same length as the guide tube extensions 22 which are approximately one half the length of the measuring bar 14. At one end of the device, an equalizing tube 26, utilizing elbow connectors 28, secures the guide tube extensions 22 together and ensures a uniform extension of the guide tube extensions 22. Mounted at the other end of the guide tube extensions 22 are O-rings 30 which ensure the retraction of the guide tube extensions 22. In the preferred embodiment, the guide rods 24 are made from a lightweight material which can be threaded, such as aluminum or plastic. The guide tube extensions 22 are typically made from a fractional tubing material of adequate strength such as aluminum, stainless steel, brass, or plastic. The elbow connectors 28 are typically made from either plastic, rubber, or metal.

Figure 3A:
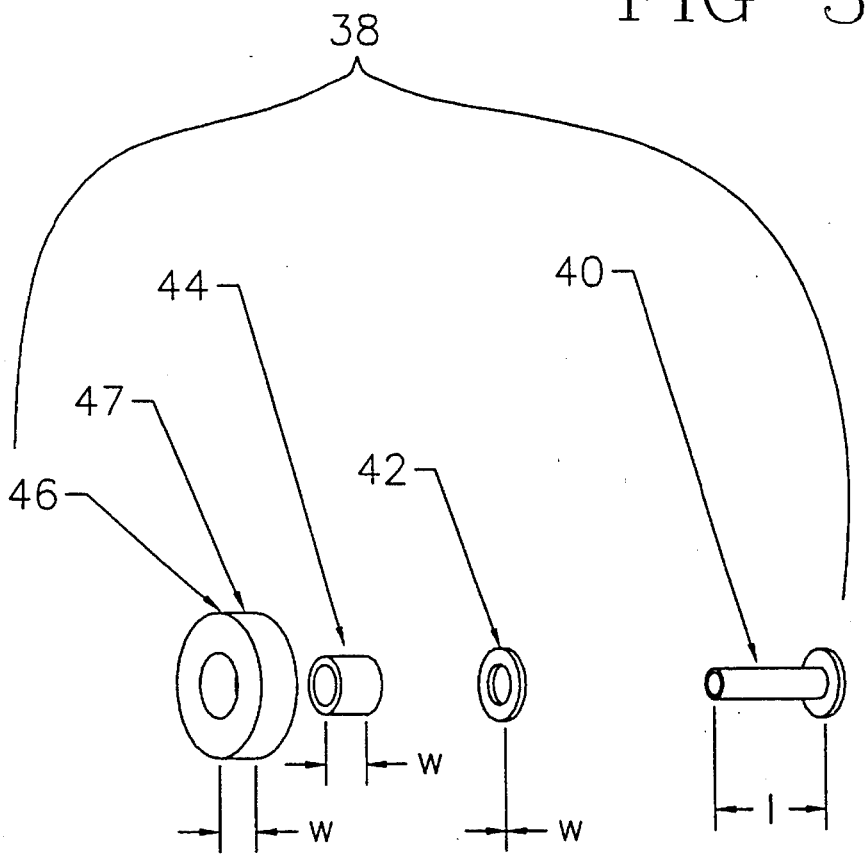
FIG. 3A is a fragmentary exploded view of a portion of the present invention.
Figure 3B:
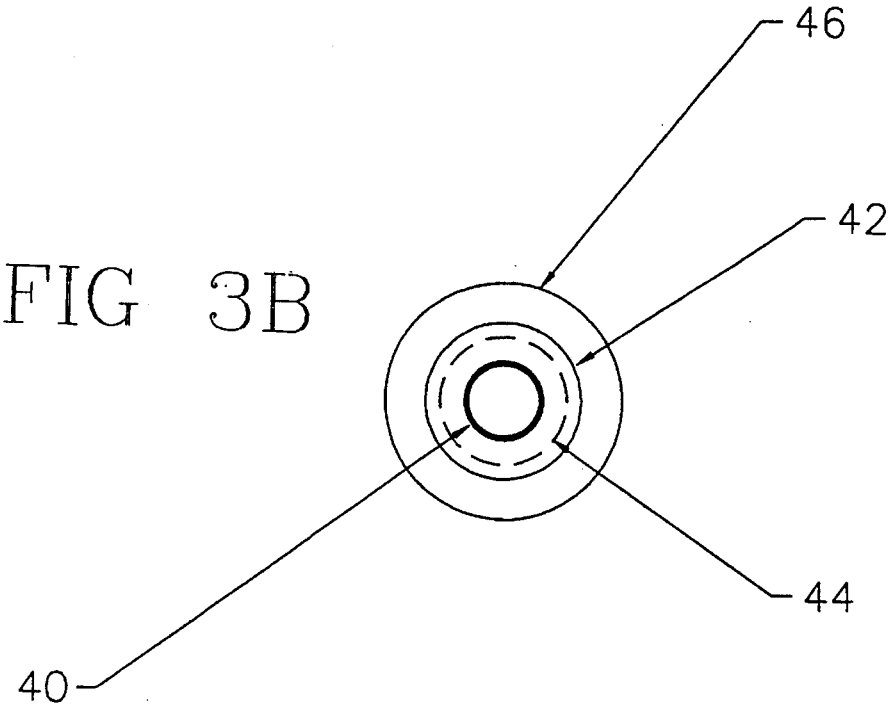
FIG. 3B is an end elevational view of portions illustrated in FIG. 3A, but in assembled form.
Figure 5:
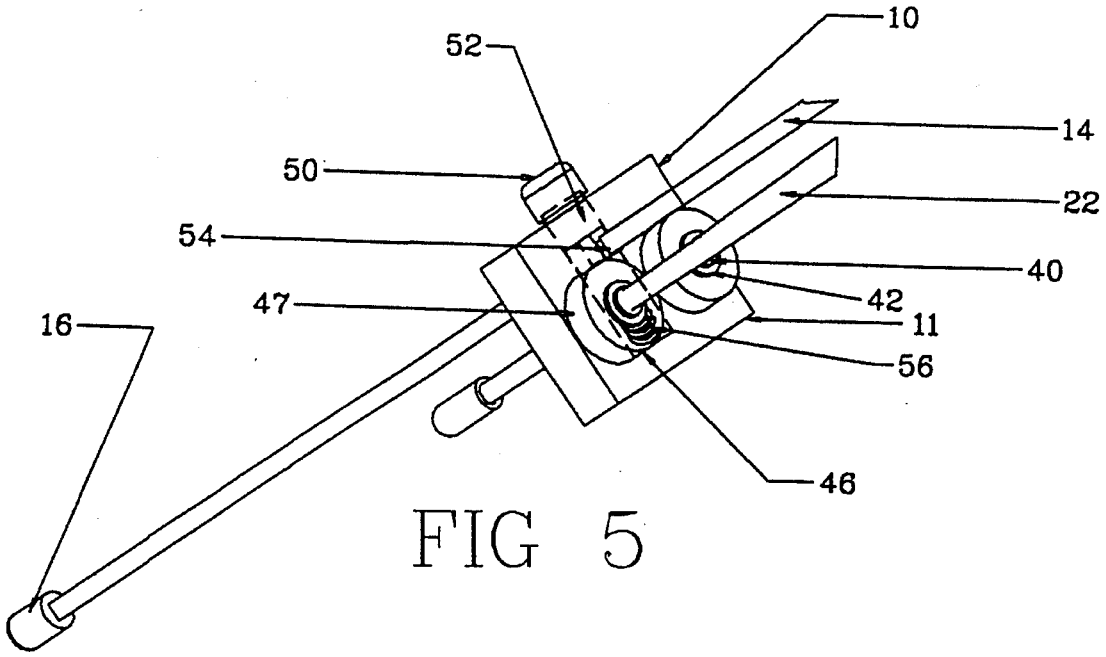
FIG. 5 is a fragmentary perspective view of a portion of the present invention showing the adjustable block and cooperatively related components.
Figure 7:
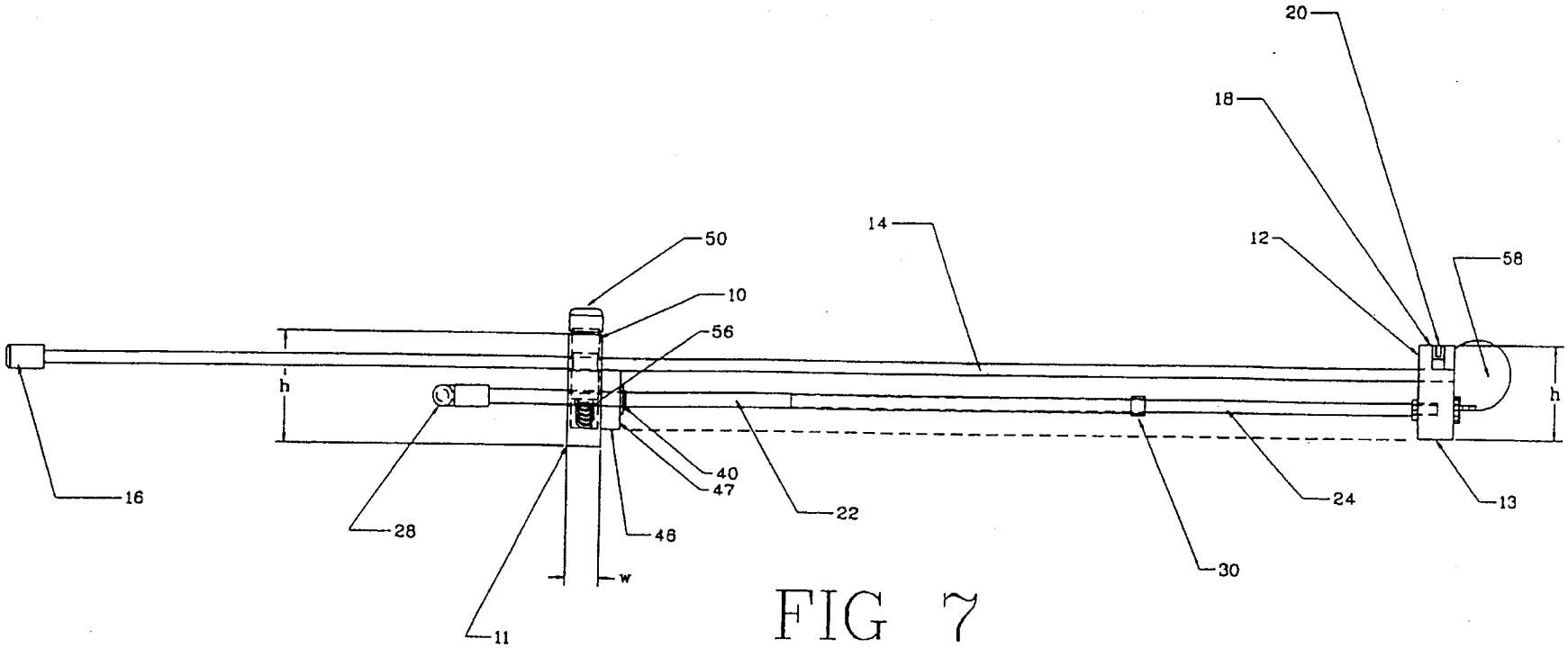
FIG. 7 is a side elevational view of the present invention with the guide tube extensions extended illustrating the different relative height dimensions "h" between the two block portions.

FIG. 3A illustrates the roller assembly designated generally by the numeral 38 and comprising a tubular spindle 40, flat washer 42, hub 44, and roller 46. The spindle 40 is press fitted to the adjustable block 10 from its inner surface, snugly securing the flat washer 42, and hub 44 assembly together. The width dimension "w" of the hub 44 is slightly greater than the width dimension "w" of the roller 46. As evident from the illustration in FIG. 3B, the outside diameter of the flat washer 42 is greater than the outside diameter of the hub 44. This arrangement keeps the two components together, yet permits the roller 46 to spin freely on the hub 44. The spindle 40 is typically flared at the inner end with either a single or double flare and is formed from a thin-walled metal tubing such as zinc, steel, brass, or aluminum. The lenght dimension "L" of the spindle 40 is typically equal to the sum of the width dimensions of the flat washer 42, hub 44, roller 46, and adjustable block 10. The rollers 46 are typically formed from a material that will provide adequate traction, such as rubber. Although some degree of traction would be lost, plastic, wood, or metal can also be used. The hubs 44 are typically formed from a rigid, lightweight material, such as plastic, aluminum or wood. As illustrated in FIGS. 5 and 7, the cylindrical peripheries of the rollers are spaced above the lower surface 11 of the block portion 10.

Figure 4:
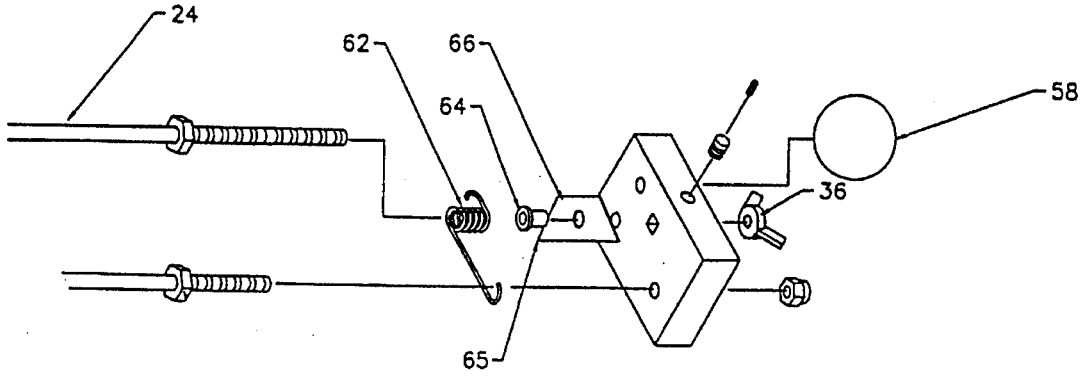
FIG. 4 is a fragmentary exploded view of a portion of the present invention illustrating the major cutting elements.
Figure 6A:
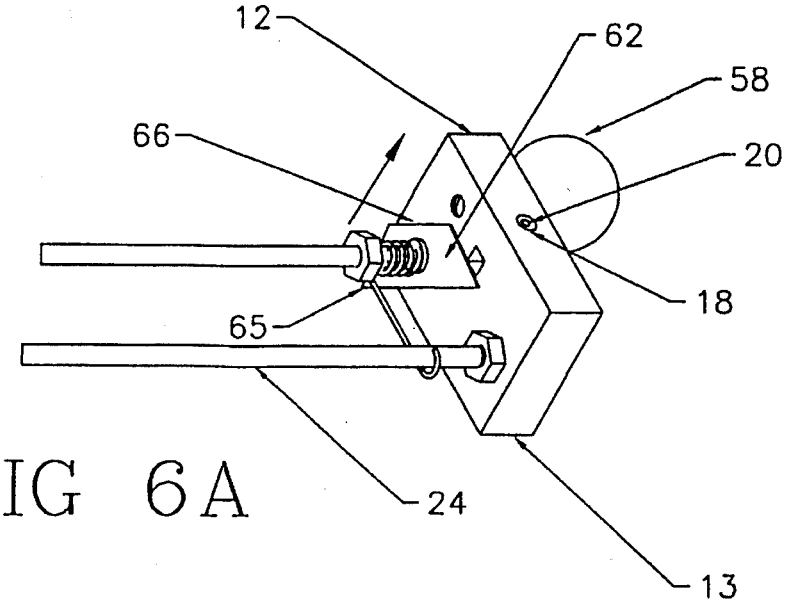
FIG. 6A is a fragmentary perspective view of a portion of the present invention showing the wing nut tightened and the tool ready for use.
Figure 6B:
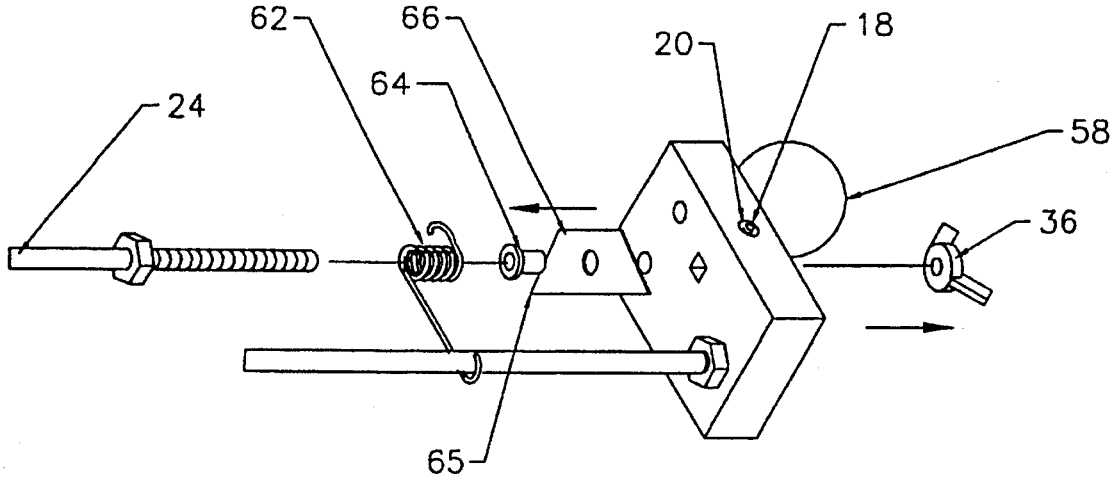
FIG. 6B is a fragmentary perspective view of a portion of the present invention showing the wing nut removed and the guide rod moved forward towards the adjustable block.
Figure 8:
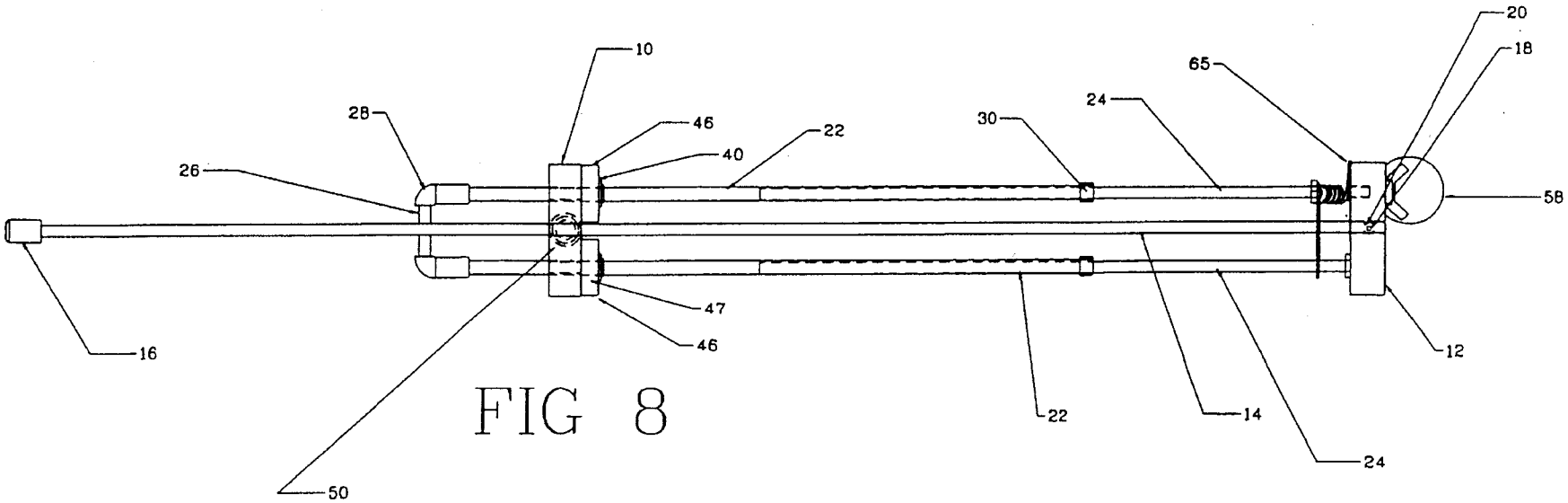
FIG. 8 is a top plan view of the present invention with the guide tube extensions extended.

As illustrated in FIG. 4, the cutting assembly includes five major elements; the guide rods 24, torsion spring 62, flange bushing 64, cutting blade 66, and wing nut 36. The blade 66 shown is a standard razor-sharp utility knife blade 66 which has a hole in the center and is readily available at most hardware stores and supply houses. The blade 66 pivots on a guide rod 24 and is further illustrated in FIG. 6A, FIG. 6B and FIG. 8. The upwardly directed arrow in FIG. 6A indicates the direction of rotation of the blade 66. The close proximity between the measuring bar 14 and guide rod 24 restricts the rotation of the blade 66 to a clockwise direction. When the tool is at rest, the outside tip 65 of the blade 66 extends below the bottom surface 13 of the stationary block 12. An open wound torsion spring 62 is positioned on the associated guide rods 24 and resiliently biases the blade in a cutting direction, so that when a downward force is exerted on the stationary block 12 in a cutting operation so as to penetrate the board being cut, both the blade 66 and torsion spring 62 may partially retract together in a clockwise direction against spring pressure, yet still exert sufficient pressure on the tip 65 of the blade to cut or score the wallboard. As partially illustrated in FIG. 6A and FIG. 6B, the blade 66 can be quickly changed with a replacement blade 66 by simple loosening and removing the wing nut 36 and moving the guide rail 22, 24 forward through the spindle 40 towards the adjustable block 10.

As illustrated in FIG. 1, FIG. 5 and FIG. 7, the locking assembly includes button 48, a coil spring 56, locking plunger 52, and cap 50. The measuring bar 14 extends through an elongated hole 54 in the locking plunger 52 which normally binds the measuring bar 14 to the adjustable block 10 by friction. This is accomplished by the coil spring 56 resiliently pushing the locking plunger 52 up so that it binds against the measuring bar 14. The hole 54 in the locking plunger 52 is typically rectangular. However, a circular hole will work too, providing the diameter of the hole is large enough to allow the locking plunger 52 to fully depress so as to release the measuring bar for movement relative to block portion 10. The locking plunger 52 is most conveniently made from a lightweight, rigid material, such as wood, plastic or aluminum. These materials are relatively inexpensive and can withstand the repeated pushing stresses associated with a mechanical button.

For reasons that will become obvious from the following description concerning the manner in which the tool is utilized, it is generally preferable that the height dimension "h" of the adjustable block 10 illustrated in FIG. 7 be greater than the height dimension "h" of the stationary block 12 and that the bottom surface 13 of the stationary block 12 illustarted in FIGS. 1 and 7, be coincident with a plane tangent to the cylindrical periphery 47 of roller 46. The block portions 10, 12 may be formed from a lightweight material of adequate strength, such as plastic, wood, or aluminum. In the preferred embodiment, the side handle 58 is generally spherical in shape and is typically formed from either plastic or wood.

Figures 9A, 9B:
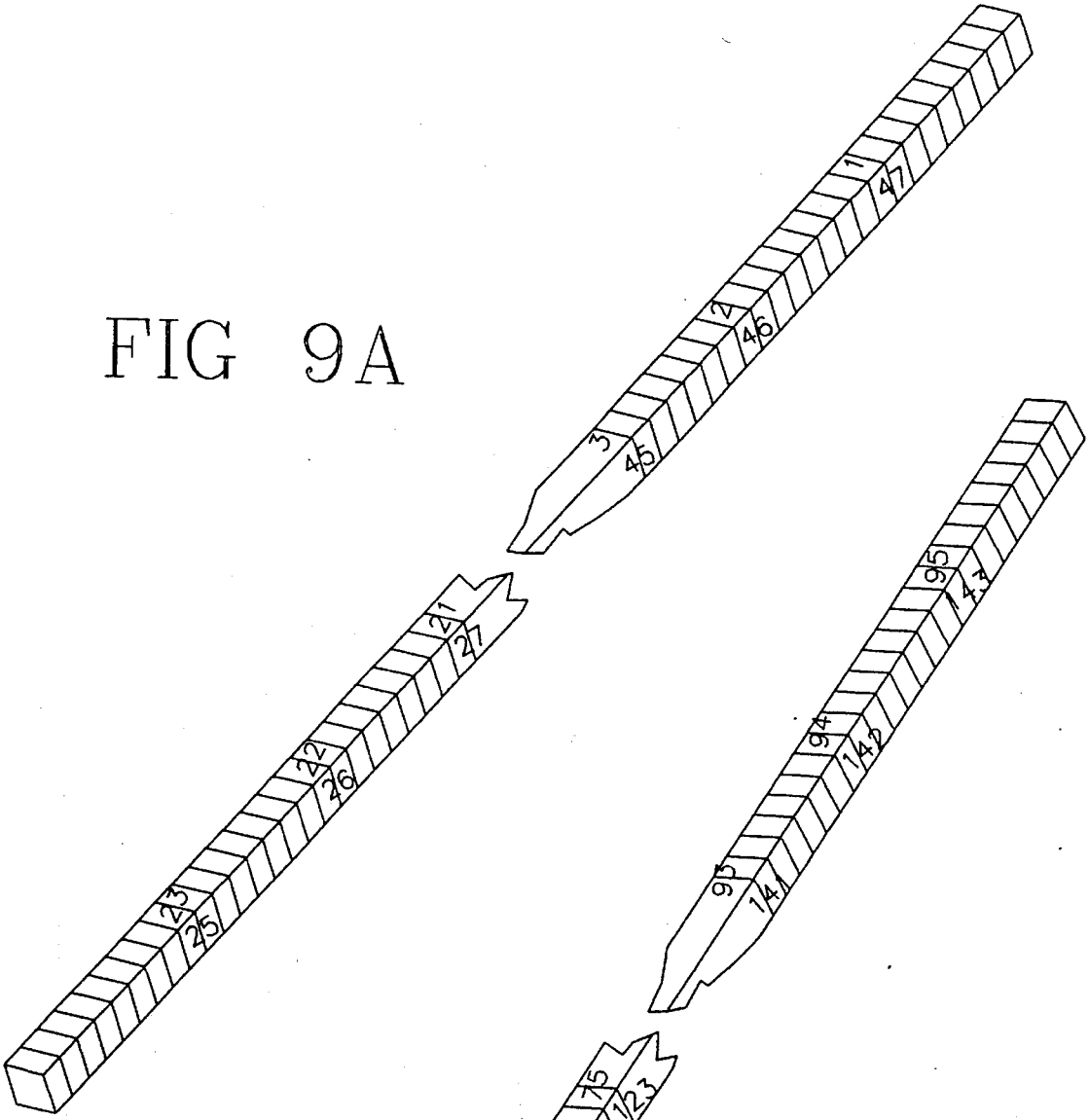
FIG. 9A and FIG. 9B are perspective views of the measuring bar.

As illustrated in FIG. 9A and FIG. 9B, the measuring surfaces comprise rulers incremented from: 0 to 24 inches, 24 inches to 48 inches, 72 inches to 96 inches, and 120 inches to 144 inches. For example, the one inch mark on the ruler incremented from 0 to 24 inches, corresponds to the 47 inch mark on the ruler incremented from 24 inches to 48 inches. Likewise, the 2 inch mark, corresponds to the 46 inch mark, etc. The four provided measuring rulers permit drywall to be accurately cut in lengths of: 0 to 4 feet, 6 feet to 8 feet, and 10 feet to 12 feet. A set screw 20 is threaded into a metal insert 18 and functions as a fine ruler adjustment and to retain one end of the measuring bar rigidly attached to block 12. The fine ruler adjustment allows the measuring bar 14 to be precisely adjusted between the two block portions 10, 12. In the preferred embodiment, the ruler is formed from a rigid plastic, which is square and tubular in cross-section, such as polyvinyl chloride, acrylonitrile, butadiene, or styrene, and slips snugly over the underlying complementarily configured bar.

From the description above, a number of advantages of my drywall cutting and scoring device become evident:

(a) The time consuming steps of measuring, marking, chalk-lining, and cutting will be completely eliminated.

(b) The tool will accurately cut or score drywall in lengths of 0 to 4 feet, 6 feet to 8 feet, and 10 feet to 12 feet.

(c) The toll can be quickly set to the required measurement by conveniently depressing a simple button.

(d) No special tools will be required to replace the blade.

(e) The presence of rollers will permit the tool to move across the face of drywall effortlessly.

(f) The tool will pierce drywall material easily and will cut to a uniform depth.

(g) The fine ruler adjustment will ensure precision cutting.

(h) Small pieces of drywall will be cut as easily as large pieces of drywall.

(i) The tool is small, practical, compact, and lightweight; yet it will cut drywall with mathematical precision in lengths up to 12 feet.

Figure 10:
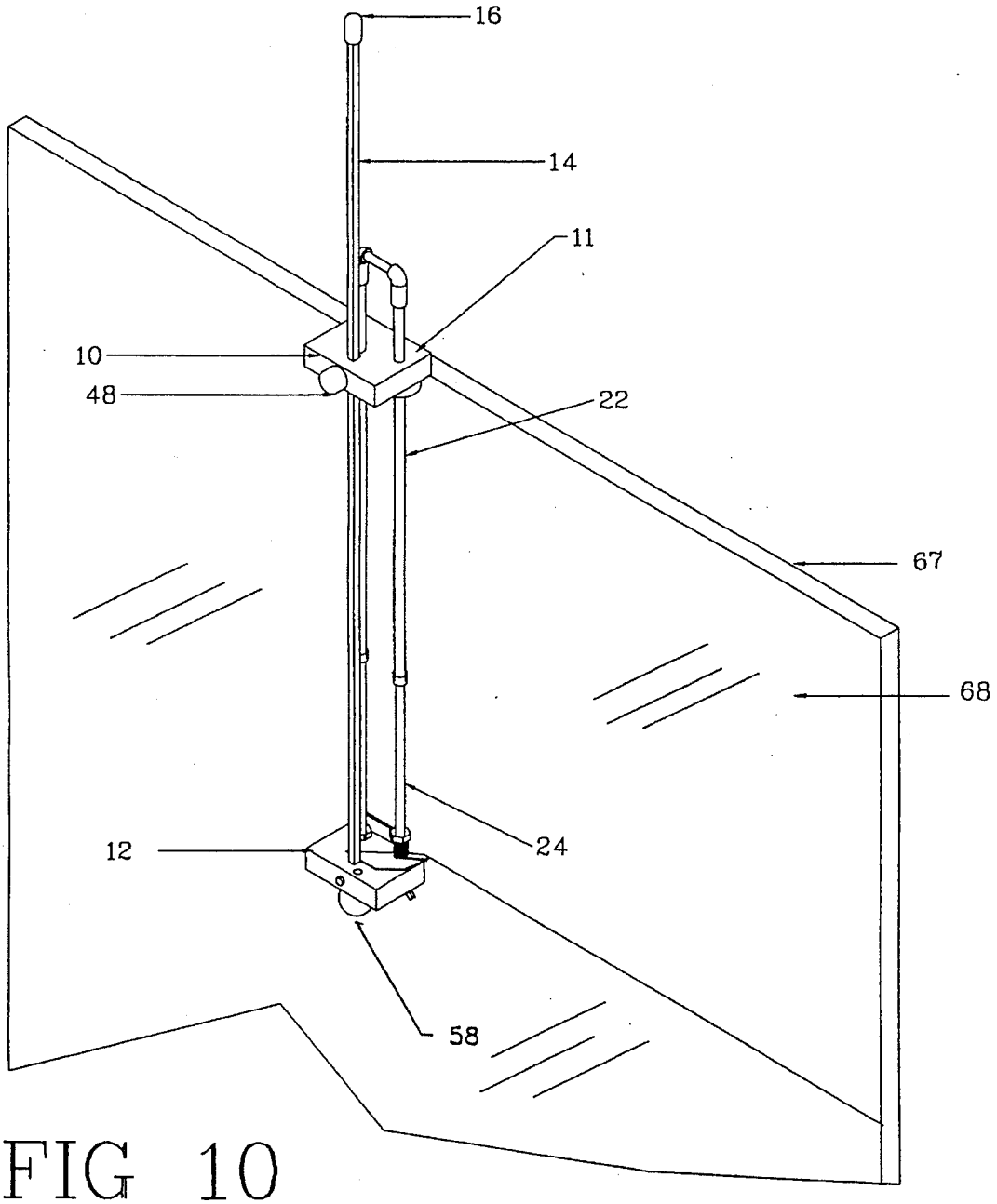
FIG. 10 is a perspective view of the drywall cutting and scoring device as it appears in use on a piece of drywall.

FIG. 10 illustrates the drywall cutting and scoring device as it appears in use on a piece of drywall 68. The tool is operated by first depressing the locking button 48 and sliding the adjustable block 10 along the guide rails 22, 24 and measuring bar 14 to the correct measurement setting. A plastic or rubber end cap 16 prevents the adjustable block 10 from sliding off the measuring bar 14 and helps to avoid snagging and personal injury. The tool is then positioned on the drywall panel 68 so that the inner surface of the adjustable block 10 engages the edge 67 of the drywall panel 68, with the rollers 46 riding on the face of the panel 68. With one hand on the adjustable block 10, and the other hand on the side handle 58, a downward force is exerted on both the stationary block 12 and adjustable block 10 to cause the blade to penetrate the layer of paper on the drywall. The tool is then slid across the drywall panel 68 to effect a cutting or scoring of the paper on the drywall and the underlying gypsum layer.

As can readily be seen from the above description, this method of cutting drywall is efficient, quick, and extremely easy.

While my above description contains many specifications, these should not be construed as limitations on the scope of the invention, but rather as an exemplification of one preferred embodiment thereof. Many other variations are possible.

For example, the measuring bar 14 can consist of any other material that is rigid and can facilitate printing, such as aluminum, steel, or wood. Although it would increase the initial cost of the tool to some extent, the ruler can be adhesive backed and printed on a 5 to 10 mil thick, rigid, polyvinyl chloride plastic; or the ruler can be printed on durable 2 mil thick mylar with a 5 mil thick top coat over the graphics to extend service; tempered steel can even be laminated to the measuring bar 14 as long as the steel is flat and about 0.006 inch thick. In the case of an adhesive backed ruler, the measuring bar 14 can consist of any other material of adequate strength which has a smooth surface and is clean and dry. The measuring bar 14 can be as long as four feet or calibrated in the metric units.

Although the block portions 10, 12 illustrated in the drawings are rectangular in cross-section, this does not preclude the block portions 10, 12 from having other shapes, such as trapezoidal, square, rhombus, oval, triangular, etc.

The torsion spring 62 can be eliminated and the blade 66 can be fixed to the stationary block 12; the roller 46 and hub 44 can be replaced with a plastic or metal roller bearing; the spindle 40 can be formed from a threaded nipple with panel nuts; the rollers 46 can be eliminated; a threaded knob with a metal insert can be used to lock the adjustable block 10 to the measuring bar 14; the side handle 58 can be eliminated and a handle can be incorporated into the stationary block 12 similar to a handle found on a common wood saw; the guide rails 22, 24 can be eliminated or one guide rail 22, 24 can be used instead of two; the guide tube extensions 22 can be flared, instead of using O-rings 30; the flange bushing 64 can be eliminated.

Although the drywall cutting and scoring device has been discussed primarily in connection with its utility for cutting drywall, and although this is the preferred use for the present invention, it should be appreciated that the device can be beneficially used to cut or score other materials. Examples of other materials which can advantageously be cut or scored include; sheetrock, gypsum board, wallboard, pegboard, gyp rock, paneling, chip board, plywood, overlay or underlay, vinyl or vinyl siding, wall molding, cardboard, wallpaper, carpet, linoleum, matting, or plastic.

Accordingly, it will be seen that the drywall cutting and scoring device provides a much needed improvement over the prior art. The tool is small, practical, and lightweight; yet it will cut drywall and other materials with mathematical precision in lengths up to 12 feet. In addition, the tool will minimize or eliminate the marking and scoring steps needed for cutting drywall. Furthermore, the drywall cutting and scoring device has the additional advantages in that

*it permits small pieces of drywall to be cut as easily as large pieces of drywall;

*it provides a superior locking element which permits the tool to be quickly adjusted;

*it permits wallboard material to be pierced more easily and provides a uniform cut;

*it provides rollers which permit the tool to slide effortlessly across the face of wallboard panel;

*it provides a blade that can easily be changed with a replacement blade by simply loosening a wing nut;

*it provides a set screw which permits the measuring bar to be precisely adjusted for precision cutting; and

*it provides a side handle which permits the tool to be easily grasped and operated by hand for improved stability when cutting.

Obviously, numerous variations and modifications can be made without departing from the spirit of the present invention. Therefore, it should be clearly understood that the forms of the present invention described above and shown in the figures of the accompanying drawings are illustrative only and are not intended to limit the scope of the present invention. Thus, the scope of the invention should be determined by the appended claims and their legal equivalent, rather than by the examples given.

I claim:

1. A drywall cutting and scoring device comprising:

a: guide means including a pair of relatively movable block portions joined by a pair of relatively slidable guide rails enabling selective relative displacement of said pair of block portions wherein said guide means includes a pair of laterally spaced parallel guide tubes mounted on one of said block portions and extending toward said other block portion, and a pair of correspondingly laterally spaced parallel guide rods mounted on said other block portion and telescopically slidably engaged in said guide tubes;

b: a measuring means mounted on said block portions and slidably disposed in one of said block portions whereby relative movement of said block portions may be gauged to indicate the spacing therebetween; and c: a cutting assembly including a razor-sharp blade mounted on said guide means and having a portion thereof adapted to penetrate a drywall when said device is drawn across said drywall.

2. The drywall cutting and scoring device according to claim 1, wherein means are interposed between said razor-sharp blade and said guide means resiliently biasing said razor-sharp blade in a direction to penetrate said drywall.

3. The drywall cutting and scoring device according to claim 1, wherein said pair of relatively movable block portions are provided with mutually facing inner surfaces, said razor-sharp blade abuts the inner surface of one of said block portions, and means rotatably mounted on said guide means and adapted to rollably engage the drywall when said device is drawn across said drywall.

4. The drywall cutting and scoring device according to claim 3, wherein said means rotatably mounted on said guide means are associated adjacent the inner surface of the block portion in which said measuring means is slidably mounted, and said cutting assembly is mounted on said guide means adjacent the inner surface of the other block portion.

5. The drywall cutting and scoring device according to claim 3, wherein said relatively movable block portions are each provided with a lower surface perpendicular to said mutually facing inner surfaces, said means rotatably mounted on said guide means are associated adjacent the inner surface of the block portion in which said measuring means is slidably mounted and includes a cylindrical surface spaced above said lower surface of an associated block portion, and said portion of said razor-sharp blade projects below the lower surface of the block portion with which it is associated an amount approximately the same as the spacing between the cylindrical surface of said means rotatably mounted on said guide means and the bottom of the block portion with which it is associated.

6. The drywall cutting and scoring device according to claim 3, wherein said relatively movable block portions are each provided with a lower surface perpendicular to said mutually facing inner surfaces, said means rotatably mounted on said guide means including a cylindrical surface spaced a predetermined distance above said lower surface of an associated block portion, and the lower surface of said other block portion being coincident with a plane tangent to said cylindrical surface.

* * * * *